US007082667B2

(12) United States Patent
Auerbach et al.

(10) Patent No.: US 7,082,667 B2
(45) Date of Patent: Aug. 1, 2006

(54) METHOD OF MAKING A LOUDSPEAKER

(75) Inventors: Richard E. Auerbach, Carmel, IN (US); David B. Garner, Indianapolis, IN (US); Louis A. Mango, III, Trafalgar, IN (US); John F. Steere, Martinsville, IN (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

(21) Appl. No.: 09/884,231

(22) Filed: Jun. 19, 2001

(65) Prior Publication Data

US 2002/0034315 A1 Mar. 21, 2002

Related U.S. Application Data

(60) Division of application No. 08/755,578, filed on Nov. 13, 1996, now Pat. No. 6,269,167, which is a continuation of application No. 08/219,117, filed on Mar. 29, 1994, now abandoned.

(51) Int. Cl.
*H04R 31/00* (2006.01)

(52) U.S. Cl. ..... 29/594; 29/857; 29/602.1

(58) Field of Classification Search ..... 29/594, 29/857, 602.1, 604; 174/116, 117 M; 381/403, 381/404, 409, 410; 156/327
See application file for complete search history.

(56) References Cited

U.S. PATENT DOCUMENTS

| | | | | |
|---|---|---|---|---|
| 1,891,404 | A | | 12/1932 | Engholm |
| 1,906,066 | A | | 4/1933 | Holst et al. |
| 1,906,379 | A | | 5/1933 | Jensen |
| 1,907,687 | A | | 5/1933 | Van Lis |
| 1,930,600 | A | | 10/1933 | Tolerton |
| 1,941,476 | A | | 1/1934 | Jensen |
| 2,019,878 | A | | 11/1935 | Tolerton |
| 2,025,087 | A | | 12/1935 | Blair |
| 2,046,515 | A | | 7/1936 | Jensen |
| 2,221,068 | A | | 11/1940 | Alons |
| 2,524,836 | A | | 10/1950 | Russell |
| 2,538,621 | A | | 1/1951 | Hopkins et al. |
| 2,554,859 | A | | 5/1951 | Hoekstra et al. |
| 2,666,980 | A | | 1/1954 | Russell |
| 2,922,850 | A | | 1/1960 | Zuerker |
| 3,014,996 | A | | 12/1961 | Swanson |
| 3,079,471 | A | | 2/1963 | Widener |
| 3,350,513 | A | | 10/1967 | Roberts |
| 3,841,952 | A | * | 10/1974 | Kimura et al. ..... 156/327 X |
| 3,941,946 | A | | 3/1976 | Kawakami et al. |
| 3,961,378 | A | | 6/1976 | White |
| 4,118,605 | A | | 10/1978 | Kobayashi |
| 4,239,944 | A | | 12/1980 | Obara et al. |

(Continued)

FOREIGN PATENT DOCUMENTS

| | | |
|---|---|---|
| DE | 35 11802 | 10/1986 |

(Continued)

*Primary Examiner*—A. Dexter Tugbang
(74) *Attorney, Agent, or Firm*—Brinks Hofer Gilson & Lione

(57) ABSTRACT

A method of making a moving coil transducer by wrapping an electrical conductor around a thread and weaving the wrapped thread at a selected location in a cloth with an overshot region. The cloth is formed into a spider with a region of the cloth adjacent the overshot region as a perimeter of the spider. The spider is incorporated into the moving coil transducer. Electrical contact is made to a moving coil of the moving coil transducer through the electrical conductor wrapped around the thread.

37 Claims, 5 Drawing Sheets

U.S. PATENT DOCUMENTS

| | | | | |
|---|---|---|---|---|
| 4,313,040 | A | 1/1982 | Tsukamoto | |
| 4,376,233 | A | 3/1983 | Kamon et al. | |
| 4,406,059 | A | 9/1983 | Scott et al. | |
| 4,559,411 | A | 12/1985 | Piper | |
| 4,565,905 | A | 1/1986 | Nation | |
| 5,008,945 | A | 4/1991 | Murayama et al. | |
| 5,091,958 | A | 2/1992 | Sakamoto et al. | |
| 5,110,999 | A | 5/1992 | Barbera | |
| 5,125,473 | A | 6/1992 | Sakamoto et al. | 181/116 |
| 5,191,697 | A | 3/1993 | Sakamoto et al. | 29/594 |
| 5,303,630 | A | 4/1994 | Lawrence | |
| 5,408,056 | A | 4/1995 | Thomas | |

FOREIGN PATENT DOCUMENTS

| | | |
|---|---|---|
| EP | 0 369 434 | 11/1989 |
| EP | 0 479 317 | 10/1991 |
| GB | 638080 | 5/1950 |
| GB | 686934 | 2/1953 |
| JP | 61-137498 | 12/1984 |
| JP | 64-897 | 1/1989 |
| JP | 62-155851 | 4/1989 |
| JP | 01295599 | 11/1989 |
| JP | 02-241297 | 9/1990 |
| JP | 03-043000 | 2/1991 |
| JP | 03-208497 | 9/1991 |
| JP | 5-85196 | 11/1993 |
| JP | 06-233382 | 8/1994 |

* cited by examiner

METHOD OF MAKING A LOUDSPEAKER

This is a division of U.S. Ser. No. 08/755,578 filed Nov. 13, 1996, now U.S. Pat. No. 6,269,167. U.S. Ser. No. 08/755,578 is itself a continuation of U.S. Ser. No. 08/219,117, filed Mar. 29, 1994 now abandoned.

FIELD OF THE INVENTION

This invention relates to improvement in the spiders of moving coil loudspeakers and in methods of making such spiders. More specifically, this invention relates to a novel loudspeaker spider material and loudspeaker construction, and to means and methods of electrically connecting the moving voice coil to the fixed loudspeaker terminals.

BACKGROUND OF THE INVENTION

There are several proposals in the prior art to incorporate into the spiders of such loudspeakers the conductors to the loudspeaker voice coil. There are, for example, the disclosures of U.S. Pat Nos.: 1,906,066; 1,906,379; 1,907,687; 2,221,068; 2,538,621; 2,922,850; 3,014,996; 3,079,471; 4,313,040; 4,565,905; 5,008,945; and, 5,091,958: United Kingdom patent specifications 638,080 and 686,934: German patent specification 3,511,802: and Japanese patent applications: 59-259,547; 61-137,498; 62-155,851; 64-897; 1-295,599; 2-241,297; and, 3-208,497. This listing is not intended as an exhaustive listing of the prior art, nor as a representation that no more pertinent prior art exists, nor should any such representation be inferred.

U.S. Pat. No. 3,014,996 discloses weaving the conductors through which electrical contact is made with the voice coil into the spider cloth. The problem with such techniques has been fatigue of the conductors as the loudspeaker operates. As the loudspeaker operates, the voice coil and its supporting mechanism, including the spider, are in constant motion and under constant flexural stress. Although the flexure of the spider is distributed across its radial width, the conductors woven into it inevitably fatigue and break, opening the electrical circuit to the voice coil.

SUMMARY OF THE INVENTION

Objectives of this invention are to provide a practical method to reduce the cost of manufacturing speakers by minimizing the number of discrete steps required to complete the assembly, and to simplify speaker assembly by reducing the component count in the final assembly process.

According to the invention a method is provided for making a loudspeaker spider incorporating the voice coil leads which enhances the flexibility of the voice coil leads.

This invention provides a new method for forming a flexible conductive path through the spider component which is well controlled, in a known position, improves productivity over other known configurations, and uses well known processes to achieve an improved configuration.

This invention also provides a composite "audio cloth" material which contains the flexible conductive path through the spider prepared by the method of this invention.

The invention also provides a molded spider component with integrally woven flexible conductive paths made from this audio cloth.

The invention also provides a method for eliminating the typical solder used as the interconnecting medium between the voice coil wires and the flexible conductors, and its attendant structural and processing problems.

The invention also provides a method to prevent stiffening and contamination of the flexible conductive cord during the process of impregnating the cloth with phenolic resin.

The invention further provides a method to produce a spider cloth and subsequently a molded spider, which method facilitates the attachment of the flexible conductors to the loudspeaker terminals.

The invention further provides the spider cloth and subsequent molded spider component made by this method.

According to an aspect of the invention, a method of making a woven spider comprises selecting a thread of the cloth from which the spider is to be woven, wrapping the selected thread with an electrical conductor, and weaving the wrapped thread at the selected location in the cloth.

Illustratively, the method further comprises the steps of, after weaving the wrapped thread at the selected location in the cloth, forming the cloth into a spider, incorporating the spider into a moving coil transducer, and making electrical contact to the moving coil of the moving coil transducer through the electrical conductor wrapped around the thread.

Further according to the invention, the step of weaving the wrapped thread at the selected location in the cloth comprises the step of weaving the wrapped thread at the selected location with a "float" or "overshoot." The step of forming the cloth into a spider comprises the step of forming a region of the cloth adjacent the float or overshoot as a perimeter of the spider.

The step of wrapping the selected thread with an electrical conductor illustratively comprises wrapping multiple threads with multiple electrical conductors, and the step of weaving the wrapped thread at the selected location illustratively comprises weaving the multiple wrapped threads at a single shed or course in the cloth.

Additionally, illustratively, the method further comprises, after wrapping multiple threads with electrical conductors and before weaving the multiple wrapped threads at a single shed or course in the cloth, the step of twisting the multiple wrapped threads together.

Further, illustratively, the method comprises, after wrapping the selected thread with an electrical conductor and before weaving the wrapped thread at the selected location in the cloth, the step of treating the wrapped thread with a first substance to render the wrapped thread relatively impervious to a second substance, and then, after weaving the wrapped thread at the selected location in the cloth, the step of treating the cloth with the second substance.

Illustratively, first substance comprises a wax. Illustratively, the second substance comprises a phenolic resin.

Additionally, illustratively, making electrical contact to the moving coil of the transducer through the electrical conductor wrapped around the thread comprises the step of applying a conductive adhesive to at least one of the electrical conductor wrapped around the thread and a lead of the moving coil.

BRIEF DESCRIPTION OF THE DRAWINGS

The invention may best be understood by referring to the following detailed description and accompanying drawings which illustrate the invention. In the drawings.

DETAILED DESCRIPTIONS OF ILLUSTRATIVE EMBODIMENTS

Figure 1:
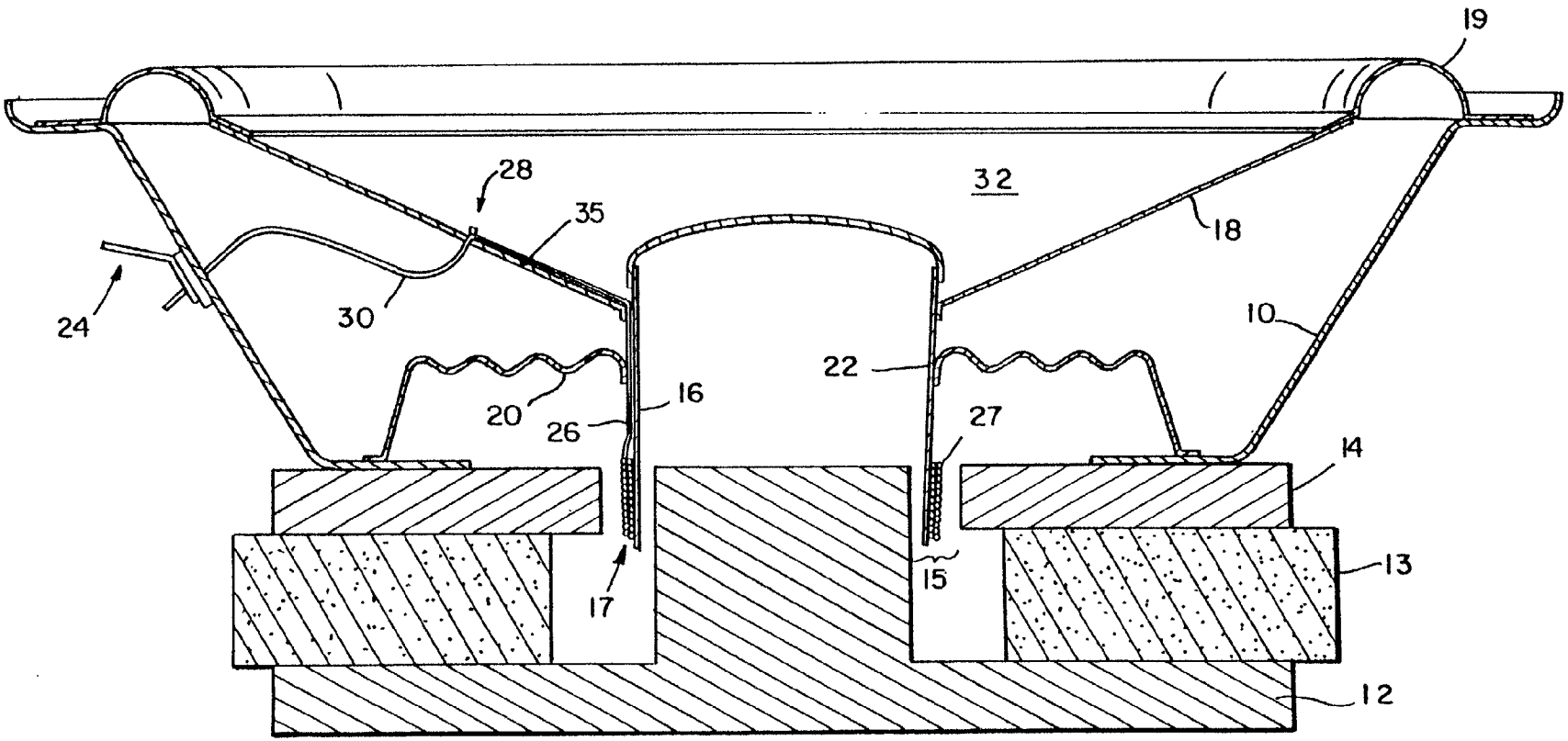
FIG. 1 PRIOR ART
FIG. 1 illustrates a cross section through a typical speaker construction.

Referring to FIG. 1, a typical loudspeaker includes a supporting frame 10 including a magnet assembly comprising a poleplate 12, a permanent magnet 13, and a front plate 14, providing a substantially uniform magnetic field across an air gap 15. A voice coil former 16 supports a voice coil 17 in the magnetic field. Current related to the program material to be transduced by the loudspeaker drives the voice coil 17, causing it to reciprocate axially in the air gap 15 in a known manner. A cone 18 attached to the end of the coil former 16 lying outside the magnet structure is coupled by a surround 19 at its outer perimeter to the frame 10. A spider 20 is coupled at its outer perimeter to the frame 10. The spider 20 includes a central opening 22 into which the voice coil former 16 is inserted and attached. The suspension including the surround 19 and spider 20 constrains the voice coil former 16 to reciprocate axially in the air gap 15.

Figure 2A:
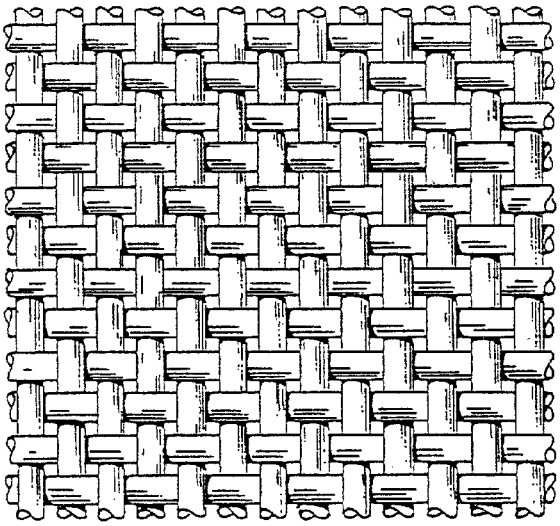
FIG. 2a PRIOR ART
FIGS. 2*a–b* illustrate an enlarged plan view and cross section, respectively, of a typical spider cloth.
Figure 2B:
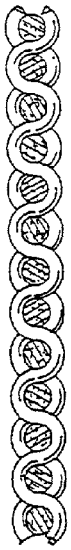
PRIOR ART FIG. 2b

Referring to FIGS. 2*a–b,* the conventional method of manufacturing a loudspeaker spider is to weave the spider from cotton, synthetic, or other yarn or yarn-like material of a size and density required to yield the desired weight, strength, and compliance needed for a particular loudspeaker design. After the raw cloth is prepared, it is impregnated with a thermosetting phenolic resin diluted with a solvent. The cloth is then dried in a warm air oven to flash off the solvent, leaving a dry, tack free surface. The cloth is then molded in a heated tool, to form the concentric convolutions typical to spiders and to cure the thermosetting resin. The spider is then trimmed to create a hole in the center and to remove the excess material from the outside diameter.

Referring to FIG. 1, the most typical configuration for completing the electrical connection between the loudspeaker terminals 24 and the voice coil wire 26 is illustrated. The voice coil wire 26 is dressed against the side of the coil former 16, and passes through the intersection of the coil former 16 and the inside diameter of the spider 20, and the intersection of the coil former 16 and the inside diameter of the cone 18, and is bonded by the adhesives used to couple these intersections mechanically. It is then dressed across the face of the cone to the point 28 on the face of the cone where it is connected to the flexible conductor 30.

This connection 28 is typically accomplished by looping or wrapping the voice coil wire 26 around the end of the flexible conductor 30, then soldering the connection 28. Alternatively, this connection 28 is sometimes facilitated by installing an eyelet (not shown) through the cone 18, positioning the ends of the voice coil wire 26 and flexible conductor 30 through the hole in the eyelet, then soldering the connection 28. After the connection 28 is complete, the connection 28 and the coil wire 26 which spans across the face 32 of the cone 18 must be firmly attached to the cone 18 with an adhesive 35 to prevent relative motion leading to spurious noises from the wire 26 striking the cone face 32, or broken voice coil wires 26. The flexible conductor 30 is loosely dressed between the connection 28 and the loudspeaker terminals 24 mounted on the frame 10, and soldered at the loudspeaker terminals 24.

The following problems attend this and similar configurations:

1. A substantial length of voice coil wire 26 must be provided to extend from the top 27 of the voice coil to the connection 28. As the voice coil assembly moves through the manufacturing process, this wire 26 is flexed frequently, increasing the likelihood of fracture or damage to the wire 26 before the loudspeaker assembly is completed.

2. The looping, wrapping, or eyeletting required to complete the mechanical and electrical connection 28 requires substantial skilled labor to complete, and adds unnecessary moving mass to the loudspeaker.

3. The soldering of the connection 28 requires manual dexterity and specific training to achieve a proper electrical connection without damaging the face of the cone.

4. The adhesive 35 which secures the connection 28 and the voice coil wires 26 to the front surface 32 of the cone 18, adds unnecessary moving mass to the loudspeaker. Adhesive 35 is typically solvent based, and in the case of resin or filled resin cones 18, can cause distortion of the cone 18 as the cone 18 swells from the solvent, and the adhesive 35 shrinks as the solvent evaporates, deleteriously affecting the performance of the speaker. Adhesive 35 also causes delays in the manufacturing process because the loudspeaker cannot be tested until the adhesive 35 cures.

5. The connection 28, voice coil wires 26, and adhesive 35 on the face of the cone 18 are aesthetically displeasing, detracting from the customer appeal of the loudspeaker.

6. Electrical connections 28 of this configuration are normally asymmetric to the axis of the loudspeaker. Since they are a component of the moving mass, they tend to induce rocking, which produces spurious sounds at various points within the audio spectrum.

7. The flexible conductor 30 must have a specific amount of slack to prevent tugging at the excursion extremes, and be dressed in such a way as to prevent striking the spider 20 or cone 18. The care required in positioning conductor 30 adds unnecessary cost to the manufacturing process.

Various proposals have been advanced to circumvent the problems inherent in the aforementioned configuration. The most interesting solutions heretofore proposed to these problems relate to attaching conductors to the surfaces of spiders by way of secondary operations to pre-existing spider cloth. Proposed solutions to add conductors to the spider have included the following:

1. Two braided tinsel conductors or tinsel cords are sewn on the surface of the spider. This adds a step in the process which unnecessarily increases the manufacturing cost, and can result in damage to the conductors where the sewing needle penetrates the cord or braid.

2. Two sets of round copper wires or tinsel conductors are interleaved into the previously woven cloth prior to molding it into the spider. This also adds a step in the process which unnecessarily increases the manufacturing cost.

3. Two thin strips of conductive material such as copper foil, beryllium copper foil, or other flexible conductor are laminated between two layers of cloth or non-woven material and then formed into a spider. This solution exhibits a very limited flex life because the conductors are tightly constrained by the laminated spider material and are not able to move to relieve the forces induced by flexure.

4. Conductive adhesive or ink is screened or painted onto one or both surfaces of the spider. This solution exhibits a limited flex life, and uniform conductivity is difficult to achieve when the conductive material is applied to the textured surface of a woven cloth.

The following methods of providing electrical connection between the voice coil wires and the flexible conductors have also been known.

1. Solder, in the form of wire or paste is common as an interconnecting medium, where the coil wire is butted against, or wrapped around the flexible conductor prior to soldering the connection. This solution tends to provide a poor quality connection when the flexible conductor is the commonly used tinsel cord, because the solder does not easily bridge across the exposed core unless the coil wire is wrapped around the tinsel cord. This requires an additional step in the process which unnecessarily increases the manufacturing cost.

In the case where the electrical connection between the flexible conductor and the coil wire is at the junction of the spider inside diameter and the coil former, a solder connection is detrimental to the structural joint. This joint is typically effected by an adhesive which is strong enough to withstand the forces generated within the loudspeaker, and pliable enough to prevent fracturing the spider at the edge of the adhesive. Adhesives of this nature typically do not adhere well to solder because it is typically an alloy of tin and lead. The adhesive joint is further compromised by any flux residue remaining from the soldering process.

2. Mechanical crimping of the flexible conductor to the voice coil wire is also known as a means of effecting this joint. This technique uses a small metal band to encircle the ends of the flexible conductor and the coil wire. The metal band is crimped around the conductor ends with a crimping tool to form a gas-tight electrical and mechanical joint. This technique exhibits the disadvantage of adding unnecessary bulk and mass to the moving assembly due to the size and density of the metal band, and the additional adhesive required to cover the band to fix it in position. This is further aggravated by the fact that an additional length of flexible conductor and voice coil wire must be provided to permit the junction to be crimped slightly away from the desired position, because the crimping tool typically cannot operate within the restricted area at the junction of the spider and coil former.

Figure 5:
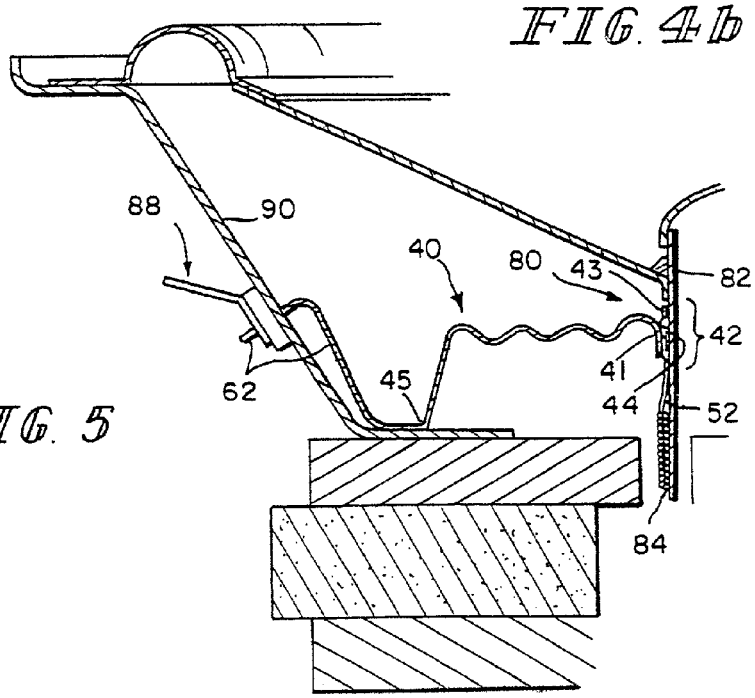
FIG. 5 illustrates an enlarged cross section through a loudspeaker assembly using a spider with flexible conductors woven as an integral component of the warp or weft, according to the present invention.
Figure 6A:
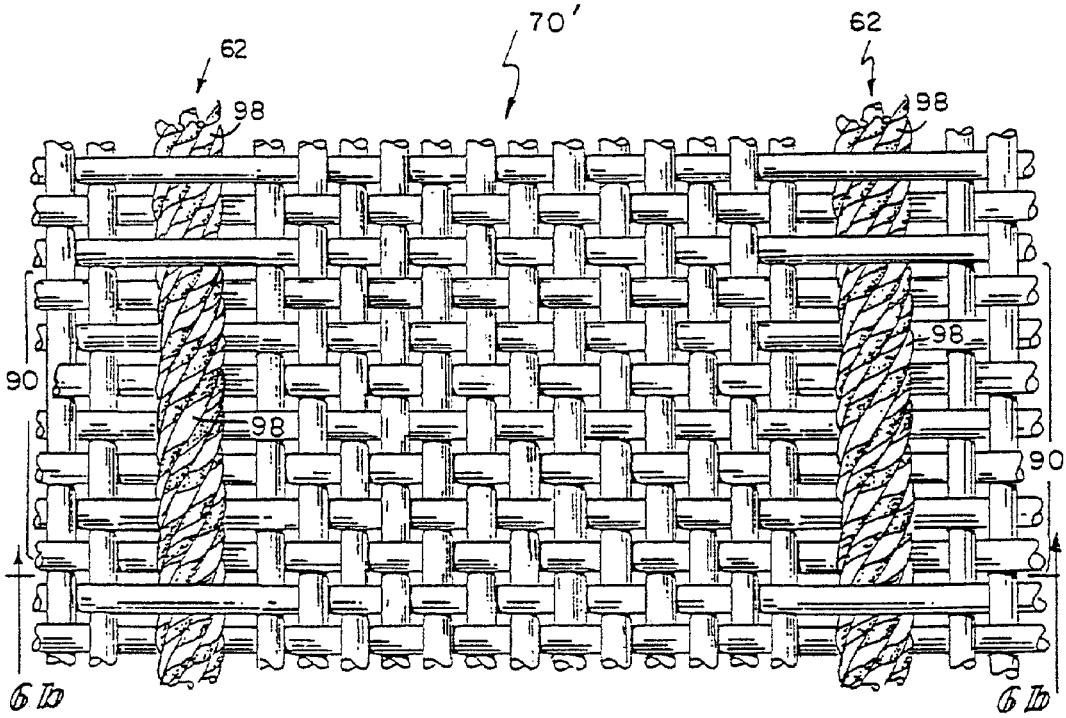
FIGS. 6*a–b* illustrate an enlarged plan view and cross-section, respectively, of a spider cloth with two sets of seven conductive strands twisted together to form two flexible conductive cords, woven as an integral part of the warp or woof, with a portion of the length of each cord left as a "float" on the surface of the cloth, according to the present invention; and, FIGS. 7*a–b* illustrate a fragmentary sectional plan view and a fragmentary sectional side elevational view, respectively, through a loudspeaker assembly incorporating a spider constructed using the cloth of FIGS. 6*a-b*.
Figure 6B:
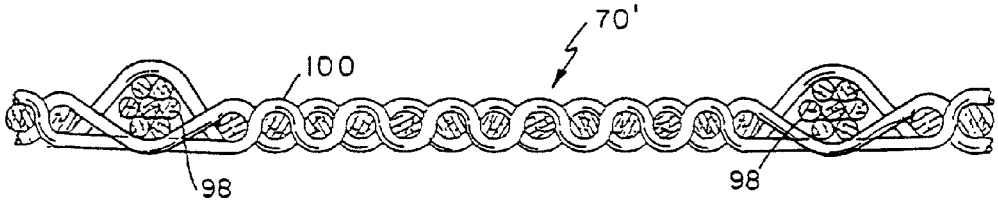
Figure 7A:
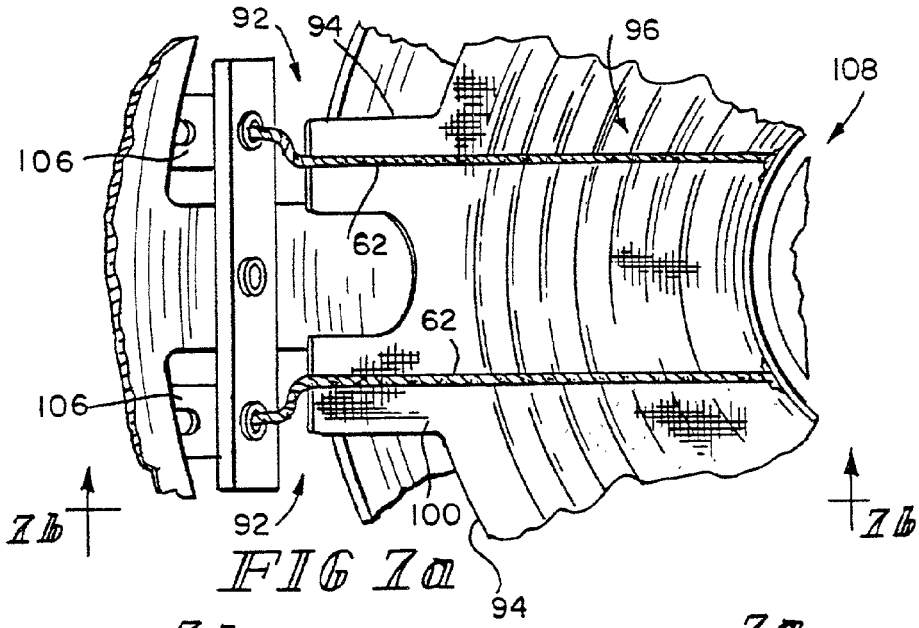
Figure 7B:
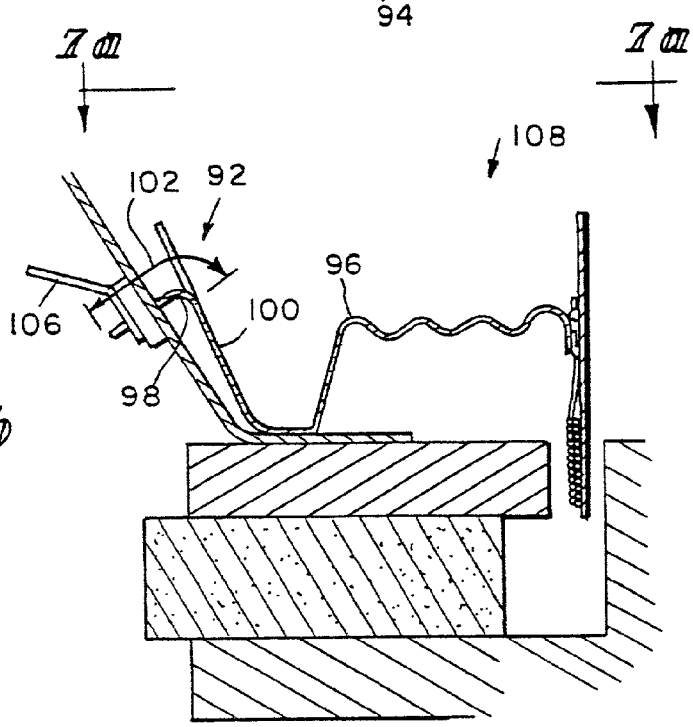

Referring to FIG. 5, the cross section of the spider 40 illustrates the contour of the spider 40 at one of the flexible conductors. FIG. 5 also illustrates the end of one of the voice coil wires 43. The area 42 of the voice coil wire 43 has been stripped of insulation. Conductive adhesive 41 interconnects the flexible conductor in the spider to the stripped area 42 of the voice coil wire 43, according to the invention.

To provide the flexible conductive path required between the voice coil and the loudspeaker terminals, conductive tinsel strands or cords are first woven on a cloth-making loom, with cotton yarn, synthetic fiber, or blends thereof, to produce a woven spider cloth with integral conductors. A wide range of yam types, sizes, plies, and weaving densities provide the weights, strengths, and compliances required for particular speaker designs.

Figure 3A:
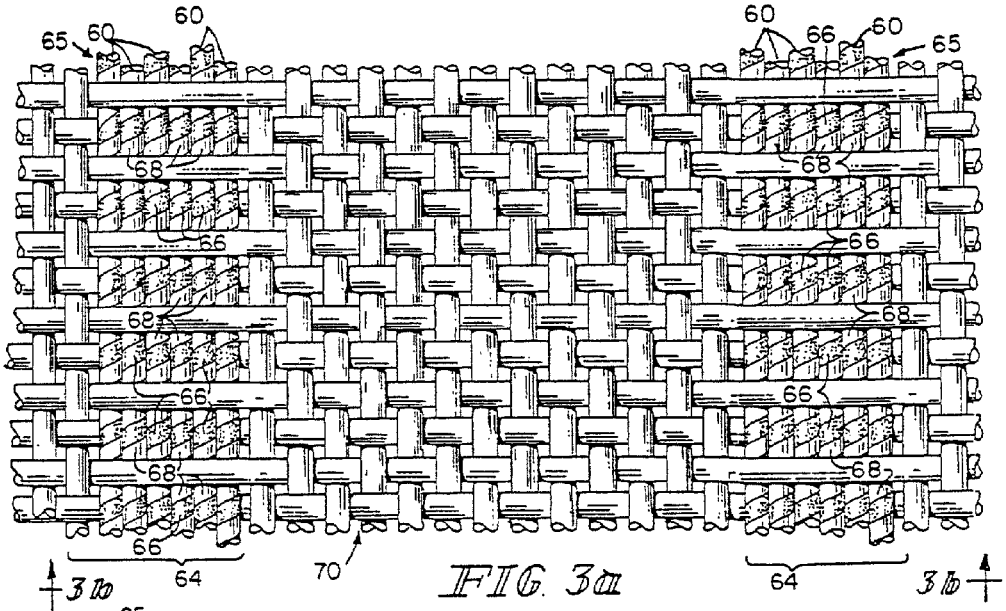
FIGS. 3*a–b* illustrate an enlarged plan view and cross section, respectively, of a spider cloth with two sets of seven parallel conductive strands, woven as an integral part of the warp or weft, according to the present invention.
Figure 3B:
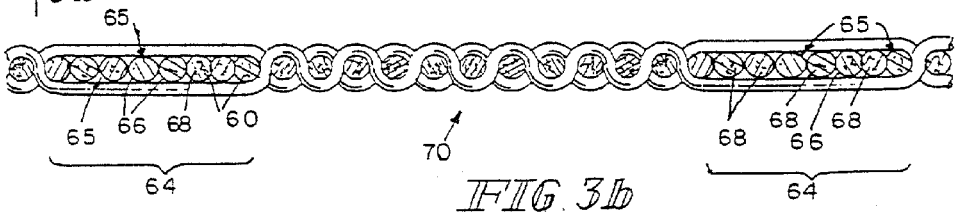
Figure 4A:
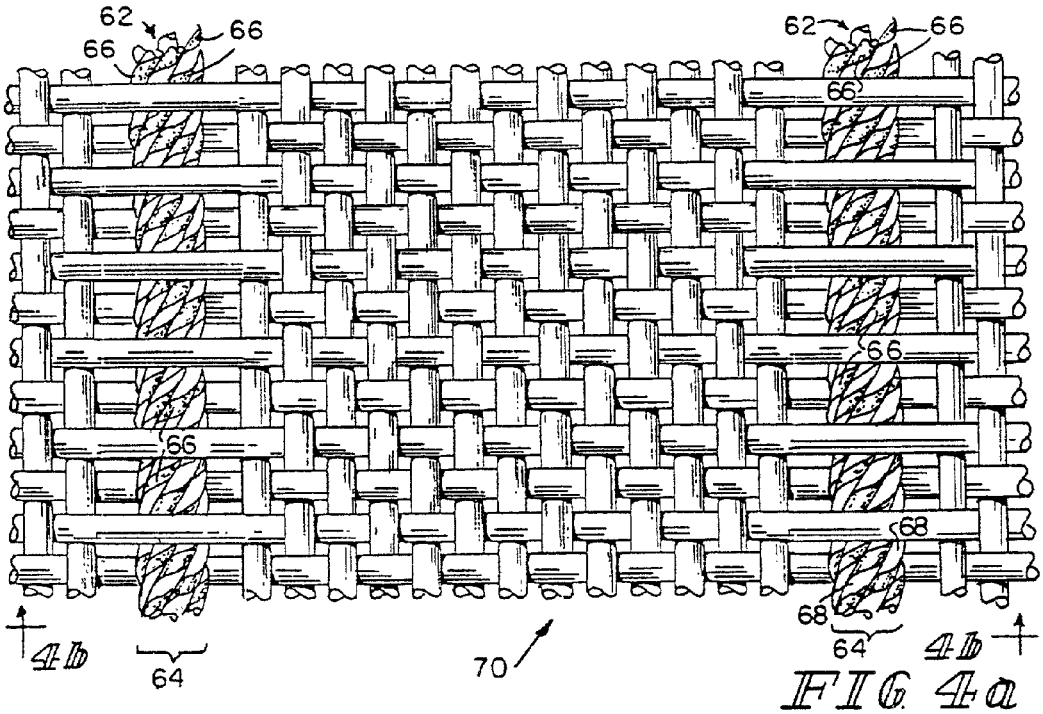
FIGS. 4*a–b* illustrate an enlarged plan view and a cross section, respectively, of a spider cloth with two sets of seven conductive strands twisted together to form two flexible conductive cords, woven as an integral part of the warp or woof, according to the present invention.
Figure 4B:
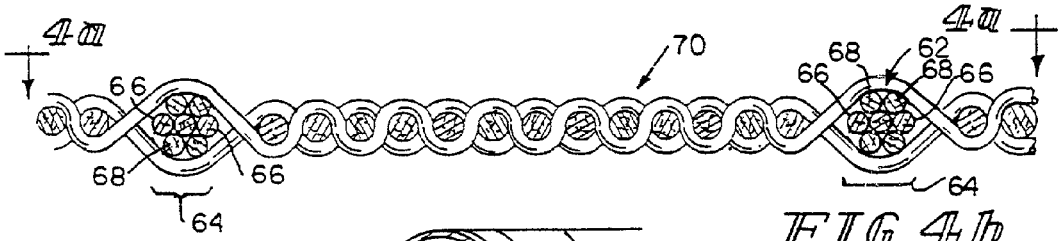

The flexible conductors 66 are applied to individual parallel strands 60 as illustrated in FIGS. 3*a–b* which may then be formed into twisted cord 62 as illustrated in FIGS. 4*a–b*, and are an integral part of the warp or weft of the cloth and serve as substitutes for a shed or course of the normal yarn. In either of these embodiments, all of the conductors in each of the two paths are confined to a single shed or course 64 to facilitate connection to the voice coil and loudspeaker terminals. Weaving the flexible conductors 66 as part of the cloth is superior to adding the conductors in a later operation, because conductors 66 woven into the cloth are at the flex locus, rather than on the surface as in the case of conductors later stitched, adhered or otherwise applied to a cloth surface. The flexible foil conductors 66 are formed from very thin conductive foil fabricated from copper, copper alloy, or silver plated copper alloy. Each of these conductors 66 is helically wrapped around a fiber core 68. The core 68 absorbs the physical stresses applied to the conductive assembly 62 and 65. The helical configuration of the conductors 66 permits the conductors 66 to withstand additional flexure without significantly stressing the conductors 66.

The illustrated embodiments of the flexible conductive assemblies 62 and 65 contemplate seven conductive strands 60 laid in a single shed 64 (FIGS. 3*a–b*) or twisted together (FIGS. 4*a–b*) to form a conductive cord 62. The multiple strands provide the total conductivity needed to minimize heating of the conductive cord 62 or 65 due to power dissipation in the cord 62 or 65. The twisting together of the multiple strands further improves the flex life of the conductive assembly by increasing the length of conductive foil 66 per unit length of the conductive cord 62. Thus, the forces induced by flexure are distributed over a longer foil conductor 66, reducing the forces per unit length of foil conductors 66.

Because the conductive cord 62 is an integral component of the base cloth 70, it will tend to become saturated and coated with phenolic resin when the cloth 70 goes through the impregnation process. To maintain solderability of the foil conductors 66, and to retain the natural flexibility of the conductive cord 62 after the cloth 70 is impregnated with phenolic, the conductive cord 62 is coated with wax prior to weaving it into the cloth 70. This can be accomplished, for example, as the final in-line process in the fabrication of the conductive cord 62. This wax will be dissipated in the high temperature spider 40 molding process, leaving the conductive foil 66 ready for interconnection.

After the cloth 70 containing the foil conductors 66 is woven, it is impregnated with a thermosetting phenolic resin diluted with a solvent. The cloth 70 is then dried in a warm air oven to flash off the solvent, leaving a dry, tack free surface.

The cloth 70 is then molded in a heated tool to form the concentric convolutions of spider 40, and to cure the thermosetting resin. The spider 40 is then trimmed to create a hole 44 in its center and to remove the excess material from its outside diameter 45.

As illustrated in FIG. 5, to form the interconnection between the voice coil wire 43 and the conductive cords 62 incorporated in the spider 40, the voice coil wire 43 is stripped of insulation and adhesive, using conventional techniques in the area 42 where it lies adjacent the spider 40. A small droplet 41 of conductive adhesive is applied to each voice coil lead 43.

After the conductive adhesive 41 is applied to the wires 43, the spider 40 is positioned with the conductive cords 62 over the conductive adhesive 41. The conductive adhesive 41 forms a small conductive fillet between the voice coil wires 43 and the flexible conductors 62 in the spider 40. A second, electrically non-conductive adhesive 80 is applied around the entire junction of the spider 40 and coil former 82 to join the spider 40 to the coil former 82. This adhesive 80 can be applied right over, and cured at the same temperature and time required to cure the conductive adhesive 41. Adhesive 80 has substantially no effect on the proximity, placement, or cure of the conductive adhesive 41. After the adhesives 41, 80 are applied, they are cured, thus completing an electrically conductive spider 40/voice coil 84 assembly. The spider 40/voice coil 84 assembly is then mounted into the loudspeaker using conventional techniques such as, for example, non-conductive adhesives, with care being taken to prevent the conductive cords 62 from being shorted to the frame 90.

The use of the conductive adhesive 41 eliminates the aforementioned problems related to the common practice of soldering this joint. The conductive adhesive 41 provides an effective structural joint with the components 40, 82 it joins. The conductive adhesive 41 also readily bridges and joins to the cores 68 of the conductive cords 62. Conductive adhesive 41 also eliminates the flux contamination typical with conventional soldering techniques.

The invention thus provides: a method of preparing a loudspeaker with woven 70, integral, multistrand 60, foil 66 conductive cords 62 as the flexible conductors required to connect the voice coil 84 to the loudspeaker terminals 88; a loudspeaker spider cloth 70 with woven, integral, multistrand 60, foil 66 conductive cords 62 as the flexible conductors required to connect the voice coil 84 to the loudspeaker terminals 88; a loudspeaker spider cloth 70 wherein the woven, integral, multistrand 60, foil 66 conductive cords 62 are grouped together in a single shed 64; a method of interconnecting the voice coil wires 43 and the flexible foil conductors 66 within the spider 40 using a conductive adhesive 41 to provide both the electrical and mechanical connections; and, a method of preserving the surface condition and flexibility of the integral flexible foil conductors 66 as the cloth 70 is impregnated with phenolic resin by treating the flexible foil conductors 66 with a wax coating as part of the fabrication process of the conductive cords 62.

FIGS. 6*a–b* and 7*a–b* illustrate an embodiment of the invention. The cloth 70' is woven using conductive cord 62 of the type illustrated in FIGS. 4*a–b*. However, a section 90 of the length of each conductive cord 62 in the region 92 adjacent what will be the edge 94 of a spider 96 preform cut from the cloth 70' is left as a float or overshoot 98. Section 90 is not woven into the cloth 70' in the manner in which the remaining lengths of the cords 62 for that spider 96 preform are woven into the cloth 70'. The reason for providing this float length 98 of each cord 62 can best be appreciated by referring to FIGS. 7*a–b*. As can be seen from FIGS. 7*a–b*, this float 98 configuration positions the cord 62 adjacent the surface 100 of the woven cloth 70' rather than within the cloth 70', for an appropriate distance 102, for example, 8 to 25 millimeters. When the spider 96 with the integral conductive cord 62 is molded, the float 98 is so positioned that it will be at the spider 96 outer perimeter and adjacent to the speaker terminals 106 when the molded spider 96 is installed in the loudspeaker 108. This float 98 permits the conductive cords 62 to be separated readily from the adjacent cloth 70'. This float 98 thus facilitates subsequent electrical connection of the cords 62 to the loudspeaker terminals 106. Such connection proceeds directly, without any additional operations to remove phenolic impregnated and molded spider cloth 70' which otherwise might interfere with the connection process.

What is claimed is:

1. A method of making a woven spider comprising selecting a non-conducting thread, helically wrapping an electrical conductor around the selected non-conducting thread and weaving the selected non-conducting thread that is wrapped with the electrical conductor into a woven cloth to form a single shed or course of the woven cloth that forms the woven spider.

2. The method of claim 1, further comprising leaving a determined length of the selected non-conducting thread that is wrapped with the electrical conductor positioned adjacent to the woven cloth in a determined position so that the selected non-conducting thread that is wrapped with the electrical conductor extends beyond an edge of the woven cloth when the woven cloth is molded and trimmed to a desired shape to form the woven spider.

3. The method of claim 1, wherein weaving comprises forming an integral part of the woven cloth that is only the selected non-conducting thread wrapped with the electrical conductor.

4. The method of claim 1, wherein weaving comprises positioning the selected non-conducting thread wrapped with the electrical conductor so that the selected non-conducting thread wrapped with the electrical conductor is a flex locus of the woven cloth.

5. The method of claim 1, further comprising leaving a determined length of the non-conducting thread that is wrapped with the electrical conductor unwoven and trimming the woven cloth to create a central opening and a desired outer circumference of the woven cloth so that the unwoven determined length of the selected non-conducting thread that is wrapped with the electrical conductor extends beyond the desired outer circumference of the woven cloth to readily provide electrical connection of the electrical conductor to a loudspeaker terminal.

6. The method of claim 1, further comprising electrically coupling the electrical conductor to a voice coil wire with a conductive adhesive, and applying a non-conductive adhesive between the woven spider and a coil former before the conductive adhesive has cured to cover the conductive adhesive and join the woven spider and the coil former.

7. The method of claim 1 and further comprising, after helically wrapping the electrical conductor round the selected non-conducting thread and before weaving the selected non-conducting thread, treating the selected non-conducted thread wrapped with the electrical conductor with a first substance to render the selected non-conducting thread relatively impervious to a second substance, and then, after weaving the selected non-conducting thread at the selected location in the woven cloth, treating the woven cloth with the second substance.

8. The method of claim 7, wherein treating the woven cloth with the second substance comprises treating the cloth with a phenolic resin.

9. A method of making a woven spider comprising selecting a non-conducting thread of a cloth from which the spider is to be woven, wrapping an electrical conductor around the selected non-conducting thread, weaving into the cloth the wrapped non-conducting thread to serve as part of the weave of the cloth, and after weaving the wrapped non-conducting thread into the cloth, forming the cloth into a woven spider.

10. The method of claim 9, where weaving the wrapped non-conducting thread further comprises weaving the wrapped non-conducting thread to serve as part of weave of the cloth in place of an unwrapped non-conducting thread.

11. The method of claim 9, where weaving the wrapped non-conducting thread comprises placing the wrapped non-conducting thread at a flex locus of the cloth.

12. The method of claim 9, further comprising, after wrapping the electrical conductor around the selected non-conducting thread and before weaving the wrapped non-conducting thread into the cloth, treating the wrapped non-conducting thread with a first substance to render the wrapped non-conducting thread relatively impervious to a second substance, and then, after weaving the wrapped non-conducting thread into the cloth at a selected location, treating the cloth with the second substance.

13. The method of claim 12, where treating the cloth with the second substance comprises treating the cloth with a phenolic resin.

14. The method of claim 9, further comprising incorporating the woven spider into a moving coil transducer and applying a conductive adhesive to at least one of;

the electrical conductor wrapped around the non-conducting thread, and a lead of a moving coil of the moving coil transducer, to make electrical contact with the moving coil transducer through the electrical conductor wrapped around the non-conducting thread, and to form a structural joint between the woven spider and the moving coil.

15. The method of claim 9, further comprising making electrical contact to a moving coil of a transducer with the electrical conductor wrapped around the non-conducting thread.

16. The method of claim 15, where making electrical contact comprises applying a conductive adhesive to at least one of the electrical conductor wrapped around the non-conducting thread and a lead of the moving coil to make electrical contact, and to form a structural joint between the spider and the moving coil.

17. The method of claim 9, where forming the cloth into a woven spider comprises forming concentric convolutions in the cloth.

18. A method of making a moving coil transducer comprising wrapping an electrical conductor around a non-conducting thread and weaving the wrapped non-conducting thread into a single layer woven cloth at a single shed or course to form part of the single layer woven cloth, after waving the wrapped non-conducting thread into the single layer woven cloth, forming the single layer woven cloth into a spider, incorporating the spider into a moving coil transducer and making electrical contact with the moving coil transducer through the electrical conductor wrapped around the non-conducting thread.

19. The method of claim 18, where weaving the wrapped non-conducting thread comprises weaving a first length of the wrapped non-conducting thread into the single layer woven cloth, positioning a second length of the wrapped non-conducting thread adjacent to the single layer of cloth to form a float, and weaving a third length of the wrapped non-conducting thread into the single layer woven cloth.

20. The method of claim 19, where forming the single layer woven cloth into a spider comprises forming a region of the single layer woven cloth that is adjacent the float as a perimeter of the spider.

21. The method of claim 18, where the step of wrapping the non-conducting thread with the electrical conductor comprises a further step of wrapping multiple non-conducting threads with multiple electrical conductors and the step of weaving the wrapped non-conductor thread comprises a further step of weaving the multiple wrapped non-conducting threads into the single layer woven cloth at a single shed or course of the single layer woven cloth.

22. The method of claim 21, further comprising, after wrapping multiple non-conducting threads with electrical conductors and before weaving the multiple wrapped non-conducting threads into the single layer woven cloth, twisting the multiple wrapped non-conducting threads together.

23. The method of claim 21, and further comprising, after wrapping the multiple non-conducting threads with multiple electrical conductors and before weaving the wrapped non-conducting threads into the single layer woven cloth, treating the wrapped non-conducting threads with a first substance to render the wrapped non-conducting threads relatively impervious to a second substance, and then, after weaving the wrapped non-conducting threads into the single layer woven cloth, treating the single layer woven cloth with the second substance.

24. The method of claim 23, wherein treating the single layer woven cloth with the second substance comprises treating the single layer woven cloth with a phenolic resin.

25. The method of claim 18, further comprising, after wrapping the non-conducting thread with an electrical conductor and before weaving the wrapped non-conducting thread into the single layer woven cloth, treating the wrapped non-conducting thread with a first substance to render the wrapped non-conducting thread relatively impervious to a second substance, and then, after weaving the wrapped non-conducting thread at the selected location in the single layer woven cloth, treating the single layer woven cloth with the second substance.

26. The method of claim 25, where treating the single layer woven cloth with the second substance comprises treating the single layer woven cloth with a phenolic resin.

27. A method of making a woven spider comprising: with a plurality of non-conducting threads, weaving a cloth in a single layer; selecting at least one of the non-conducting threads; wrapping the at least one of the non-conducting threads with an electrical conductor; weaving the at least one of the non-conducting threads that is wrapped with the electrical conductor at a single shed or course of the cloth to form an integral part of a warp or a well of the cloth.

28. The method of claim 27, further comprising forming the cloth that includes the at least one of the non-conducting threads that is wrapped with the electrical conductor into a spider.

29. The method of claim 27, where the at least one of the non-conducting threads that is wrapped with the electrical conductor is woven with another of the non-conducting threads to form the cloth.

30. The method of claim 27, further comprising after the at least one of the plurality of non-conducting threads that is wrapped with the electrical conductor is woven into and forms part of the weave of the cloth, forming the cloth into a spider.

31. The method of claim 30 further comprising incorporating the spider into a moving coil transducer and making electrical contact with the moving coil transducer through the electrical conductor wrapped around the at least one of the non-conducting threads.

32. The method of claim 27, where weaving the at least one of the non-conducting threads that is wrapped with the electrical conductor comprises weaving a first length of the at least one of the non-conducting threads at a single shed or course of the cloth to form an integral part of a warp or a weft of the cloth, positioning a second length of the at least one of the non-conducting threads that is wrapped with the electrical conductor adjacent to the cloth to form a float, and weaving a third length of the at least one of the non-conducting threads that is wrapped with the electrical conductor at a single shed or course of the cloth to form an integral part of a warp or a weft of the cloth.

33. The method of claim 32, further comprising forming the cloth into a spider and forming a region of the cloth that is adjacent the float as a perimeter of the spider.

34. The method of claim 27, where the step of wrapping the at least one of the non-conducting threads with the electrical conductor comprises a further step of wrapping multiple non-conducting threads with multiple electrical conductors and the step of weaving the at least one of the non-conducting threads that is wrapped wit the electrical conductor comprises a further step of weaving the multiple wrapped non-conducting threads at a single shed or course of the cloth to form an integral part of a warp or a weft of the cloth.

35. The method of claim 34, further comprising, after wrapping multiple non-conducting threads with multiple electrical conductors and before weaving the multiple wrapped non-conducting threads at a single shed or course of the cloth, twisting the multiple wrapped non-conducting threads together.

36. The method of claim 34, and further comprising, after wrapping the multiple non-conducting threads with multiple electrical conductors and before weaving the multiple wrapped non-conducting threads at a single shed or course of the cloth, treating the multiple wrapped non-conducting threads with a first substance to render the multiple wrapped non-conducting threads relatively impervious to a second substance, and then, after weaving the multiple wrapped non-conducting threads at a single shed or course of the cloth, treating to cloth with the second substance.

37. The method of claim 36, wherein treating the cloth with the second substance comprises treating the cloth with a phenolic resin.

* * * * *

UNITED STATES PATENT AND TRADEMARK OFFICE

CERTIFICATE OF CORRECTION

PATENT NO. : 7,082,667 B2
APPLICATION NO. : 09/884231
DATED : August 1, 2006
INVENTOR(S) : Richard E. Auerbach et al.

It is certified that error appears in the above-identified patent and that said Letters Patent is hereby corrected as shown below:

Title Page

Column 1
Line 1, Item (54), delete "Method Of Making A Loudspeaker" and insert -- Woven Spider For A Loudspeaker --

Column 8
Line 51, delete "round" and insert -- around --.

Column 9
Line 25, delete "," and insert -- : --.

Column 10
Line 47, delete "well" and insert -- weft --.

Column 11
Line 19, delete "wit" and insert -- with --.

Signed and Sealed this

Twenty-eighth Day of November, 2006

JON W. DUDAS
*Director of the United States Patent and Trademark Office*